US007404648B1

(12) United States Patent
Schwarz et al.

(10) Patent No.: US 7,404,648 B1
(45) Date of Patent: Jul. 29, 2008

(54) CONCEALABLE MIRROR

(76) Inventors: Robert F. Schwarz, 2203 Aspenwood La., Columbus, OH (US) 43235; Ben Schellhaas, 120 N. Center St., West Jefferson, OH (US) 43162

( * ) Notice: Subject to any disclaimer, the term of this patent is extended or adjusted under 35 U.S.C. 154(b) by 62 days.

(21) Appl. No.: 11/561,013

(22) Filed: Nov. 17, 2006

Related U.S. Application Data

(60) Provisional application No. 60/826,742, filed on Sep. 24, 2006.

(51) Int. Cl.
*G02B 5/08* (2006.01)
*G02B 7/182* (2006.01)

(52) U.S. Cl. ..... 359/872; 359/877

(58) Field of Classification Search ..... 359/854, 359/855, 872, 877
See application file for complete search history.

(56) References Cited

U.S. PATENT DOCUMENTS 1,790,406 A * 1/1931 Cooper ..... 16/72
3,488,115 A * 1/1970 Nemec et al. ..... 353/99
4,279,110 A 7/1981 Palazzolo et al.
4,639,106 A 1/1987 Gradin
4,651,258 A 3/1987 Davis et al.
5,060,124 A 10/1991 Crispin et al.
5,081,566 A 1/1992 Crispin et al.
5,798,881 A * 8/1998 Mazurek et al. ..... 359/872
6,109,755 A * 8/2000 Duroux et al. ..... 359/841
6,296,363 B2 * 10/2001 Chabot ..... 359/879
6,343,863 B1 * 2/2002 Wood ..... 353/13
6,379,012 B1 * 4/2002 Enochs et al. ..... 353/79
6,484,993 B2 11/2002 Huffman
6,508,579 B1 1/2003 Ruud et al.
6,554,456 B1 4/2003 Buelow, II et al.
6,808,274 B2 * 10/2004 Raines et al. ..... 359/841
6,811,265 B2 * 11/2004 Soper et al. ..... 353/99
6,837,581 B1 * 1/2005 Raines et al. ..... 353/13

* cited by examiner

*Primary Examiner*—Ricky D Shafer
(74) *Attorney, Agent, or Firm*—Ronald J. Koch

(57) ABSTRACT

A concealable mirror comprises motor housing 110, motor 111, motor shaft 112, pivot arm 131, link arm 140, frame 210, hinge 212, cover deck 220, mirror frame 301, mirror 310, remote control device 400, and clevis assembly 502.

12 Claims, 6 Drawing Sheets

CONCEALABLE MIRROR

CLAIM OF PRIORITY BASED ON COPENDING PROVISIONAL APPLICATION

The present application is related to the co-pending Provisional patent application No. 60/826,742 of ROBERT F. SCHWARZ, et al, filed Sep. 24, 2006, entitled "CONCEALABLE MIRROR", and based on which priority is herewith claimed under 35 U.S.C. 119(e) and the disclosure of which is incorporated herein by reference in its entirety as if fully rewritten herein.

BACKGROUND AND SUMMARY

The present invention relates to mirror apparatus, and in particular to mirror apparatus that are mounted in ceilings that can be positioned for viewing reflections of specific areas in a room that are at some arbitrary angle from vertical in addition to directly below the mirror. E.g. Birthing room mirrors.

Floor stand mirrors have been used to assist in the birthing process. They take up valuable floor space, are difficult to position for optimum viewing and create a distraction to the procedure when setting up. Accordingly, it would be advantageous to provide a mirror that eliminates these shortcomings.

Ceiling mounted mirrors have been used but have several disadvantages.

The present invention overcomes these disadvantages by incorporating various improvements.

The invention allows the mirror to be easily adjusted to optimize the field of view. When not in use, it is stored flush with the ceiling.

It is designed to be mounted in a suspended ceiling plenum area and directly replaces an existing ceiling tile. The mirror position can be variably adjusted by the observer to optimize the view.

The mirror is stored flush with the ceiling in the closed position. This is advantageous because its presence is minimized when not in use. Viewing space is maximized since the mirror is essentially the same size as the ceiling tile it replaces.

The limit switch arrangement for the stored position of the mirror assures that the mirror is always flush with the ceiling, irrespective of any wear in the raising-lowering mechanism.

The invention is nearly totally enclosed thus prohibiting plenum debris from entering the patient area of the room.

The motor and some linkage are separated from the patient area. Other units are not sealed and therefore debris from the plenum area can infiltrate into the patient area.

An improved actuating mechanism provides a lower profile that essentially eliminates mechanical interference with existing equipment and other appurtenances in the plenum area.

Other units have a higher profile and therefore restrict installation to ceiling locations where there is sufficient vertical clearance in the plenum above the ceiling grid. The device therefore provides greater flexibility in mounting locations.

The mirror is not manipulated by a linear actuator as other units are. They are comprised of a greased jack screw that is exposed to the patient area. This is further disadvantageous because such an embodiment necessitates a higher, less compact profile by virtue of the need for a robust motor frame.

The actuating mechanism (discussed below) of the present invention does not require such a motor housing to be welded and is therefore less expensive to construct.

The present invention is lighter because it is made from aluminum and does not need the aforementioned motor frame. The lighter weight of the preferred embodiment facilitates installation.

A novel actuating mechanism comprises fewer moving parts with no exposed greased elements. Actuation of the mirror is accomplished by means of a simple reversible gear motor.

The present invention is self locking in the stored (closed) position. A force equivalent to the weight of the mirror must be constantly applied to keep the mirror in the stored position. Other devices are not self locking. Therefore, a braking mechanism must be employed to hold the mirror in the closed position. The novel actuator arrangement of this invention substantially eliminates the reaction torque on the motor when the mirror is stored.

REFERENCE NUMERALS IN DRAWINGS

Figure 1:
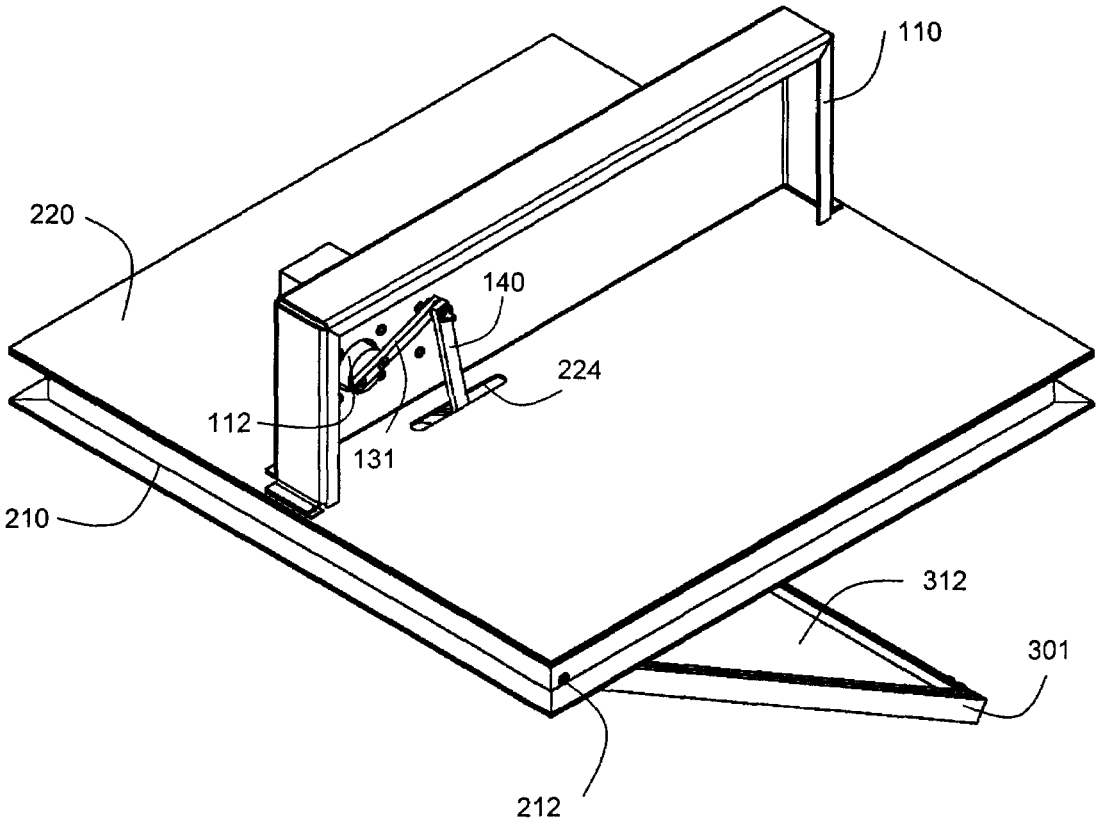
FIG. 1 depicts a perspective view showing the top of the invention
Figure 2:
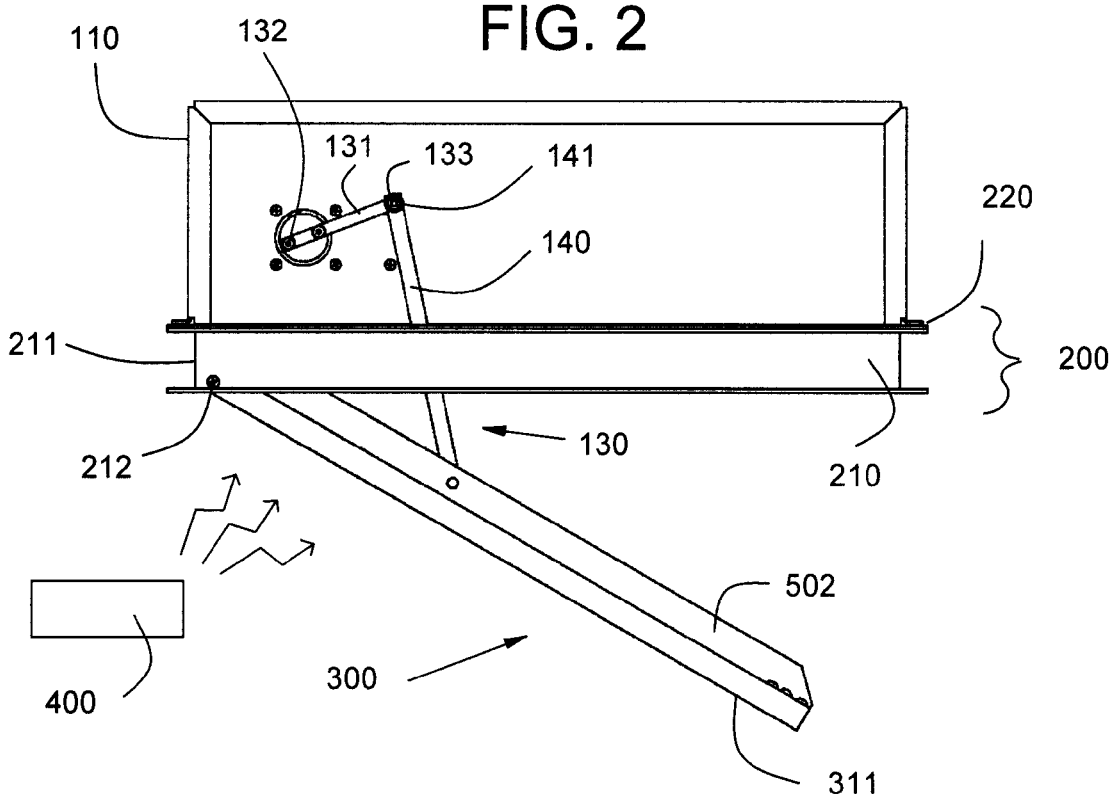
FIG. 2 depicts a side view of the invention
Figure 3:
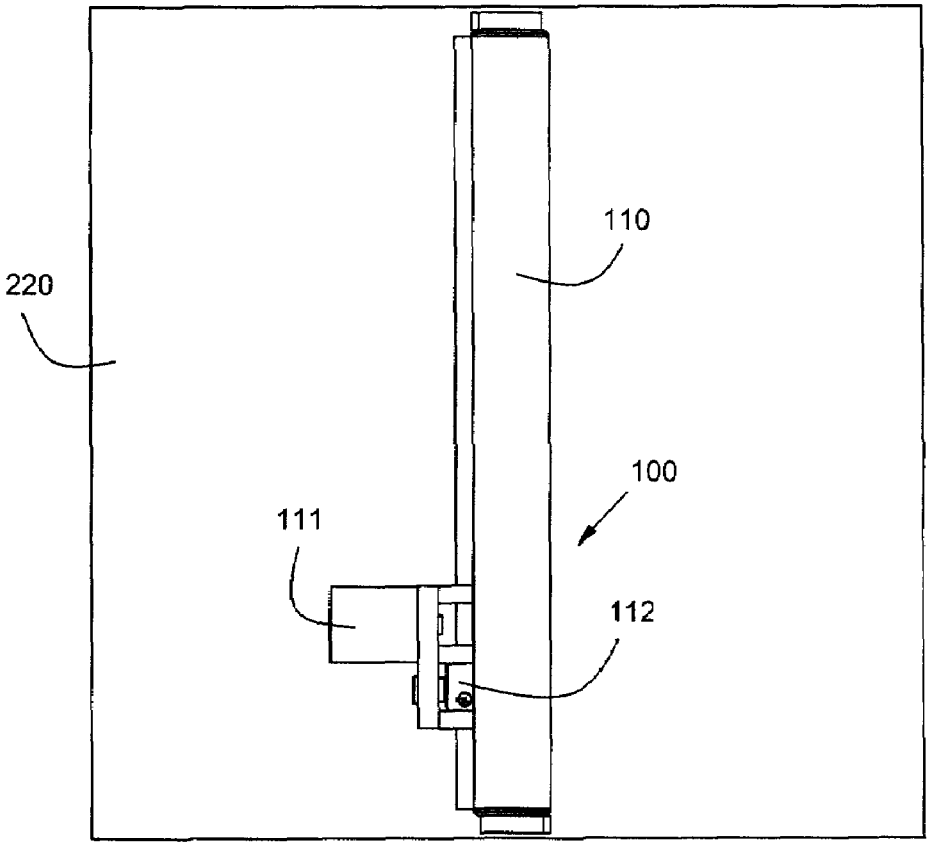
FIG. 3 depicts a plan view of the invention

The table below lists the reference numerals employed in the figures, and identifies the element designated by each numeral.

| | |
|---|---|
| 100 | motor assembly 100 |
| 110 | motor housing 110 |
| 111 | motor 111 |
| 112 | motor shaft 112 |
| 130 | pivot assembly 130 |
| 131 | pivot arm 131 |
| 132 | first end 132 of pivot arm |
| 133 | second end 133 of pivot arm |
| 140 | link arm 140 |
| 141 | first end 141 of link arm |
| 142 | second end 142 of link arm |
| 200 | base unit 200 |
| 210 | frame 210 |
| 211 | first side 211 of frame |
| 212 | hinge 212 |
| 220 | cover deck 220 |
| 221 | first side 221 of cover deck |
| 222 | cover deck upper surface 222 |
| 223 | cover deck lower surface 223 |
| 224 | cover deck aperture 224 |
| 300 | mirror assembly 300 |
| 301 | mirror frame 301 |
| 302 | first side 302 of mirror frame |
| 310 | mirror 310 |
| 311 | mirror reflective surface 311 |
| 312 | mirror rear surface 312 |
| 400 | remote control device 400 |
| 500 | Link #A of four-bar linkage 500 |
| 501 | Link #D of four-bar linkage 501 |
| 502 | clevis arrangement 502 |

DETAILED DESCRIPTION

As will be appreciated by those in the art, the present invention is preferably made from aluminum because of its strength and weight characteristics. However, other materials can be used provided those materials have sufficient strength to allow the invention to operate. Heavier materials are not preferred because they pose additional burdens on the supporting structure (ceiling joists, etc.). It will also be appreciated that the various pieces (described below) used to construct the present invention may be attached to each other by conventional means such as welding, soldering, bolts, screws, rivets, or any other suitable means.

A concealable mirror comprises motor housing 110, motor 111, motor shaft 112, pivot arm 131, link arm 140, frame 210, hinge 212, cover deck 220, mirror frame 301, mirror 310, remote control device 400, and clevis assembly 502.

The base unit 200 comprises a cover deck 220 and a frame 210. The cover deck 220 is substantially planar, has an aperture 224, a first side 221, an upper surface 222, and a lower surface 223.

The frame 210 is rectangular in shape. It is comprised of elongated, rigid members having a c-shaped cross section, and is preferably 2 inches high, but other heights may be used.

The aperture 224 may be round or of any shape suitable to allow movement of pivot assembly 130 (discussed below). It is located approximate the center of the cover deck 220. The purpose of the aperture is to allow link arm 140 to pass through to engage mirror assembly 300. Various means of engagement may be used. A preferred embodiment comprises the first end 141 of the link arm 140 pivotably secured to the second end 133 of pivot arm and the second end 142 of link arm 140 pivotably secured to clevis arrangement 502 and Clevis arrangement 502 is securedly attached to rear surface 312 of mirror 310.

The frame 210 has a first side 211 and is fixedly secured to the lower surface 223 of the cover deck 220. The first side 221 of the cover deck 220 is adjacent to the first side 211 of the frame 210.

The mirror assembly 300 comprises a mirror 310 and a mirror frame 301. The mirror assembly 300 preferably weighs less than or equal to 5 lbs. This minimizes torque on the motor shaft 112.

The mirror frame 301 is rectangular in shape and has a first side 302. The mirror 310 has a reflective surface 311 and a rear surface 312 and is fixedly secured to the mirror frame 301. This can be accomplished by brackets, set screws, or other suitable means. The reflective surface 311 of the mirror faces away from the cover deck.

The first side 211 of the frame 210 is hingedly secured to the first side 302 of the mirror frame 301. Although a hinge is preferred, other methods may be used. For instance, multiple hinges, or a flexible material such as a strong fabric or mesh.

The frame 210 and the mirror assembly 300 are capable of planar movement with respect to each other. The planes of the frame and mirror assembly are substantially parallel in the closed position. The range of movement is preferably from 0 to 65 degrees, inclusive. This allows the present invention to be used with different ceiling heights relative to the surface upon which the object to be viewed is positioned. As a woman giving birth (or other person laying horizontally with a need to view their perineal region) takes advantage of the invention, the mirror is actuated by remote control 400.

A motor assembly 100 comprises a motor housing 110, a motor 111, and motor shaft 112. The motor housing 110 is fixedly attached to the upper surface 222 of the cover deck 220. The motor 111 is fixedly attached to the motor housing 110.

The pivot assembly 130 comprises a pivot arm 131, a link arm 140, and a clevis arrangement 502. The pivot arm 131 has first and second ends 132, 133 respectively. The pivot arm 131 is preferably 3 inches in length. However, other lengths may be used.

The first end 132 of pivot arm 131 is fixedly secured to the motor shaft 112. The link arm 140 has first and second ends 141 and 142, respectively. Link arm 140 is preferably 8.9 inches in length, but other lengths may be used.

The second end 133 of the pivot arm 131 is pivotably secured to the first end 141 of link arm 140. The second end 142 of link arm 140 is pivotably secured to clevis arrangement 502. Clevis arrangement 502 is securedly attached to rear surface 312 of mirror 310. It is understood that rear surface 312 could include a thin laminate (not shown) adhered to the back of mirror 310. in this embodiment, Clevis arrangement 502 would be securedly attached to the laminate.

Pivot arm 131 and link arm 140 rotate pivotally with respect to each other. The range of this rotation is preferably from zero to 180 degrees, inclusive, but other ranges may be used.

As will be appreciated by those in the art, other embodiments are possible to accomplish the function of pivotal attachment of second end 142 of link arm 140 to rear surface 312 of mirror 310. One or more hinges may be used. Flexible materials such as mesh may also be used. The pivot assembly 130, mirror assembly 300, and base unit 200 must work together to move the mirror between open and closed positions as driven by the motor 111. Accordingly, analysis of this configuration is facilitated by a "four-bar linkage" analysis. Various preferred conditions are considered as the various configurations are analyzed using the four-bar linkage model.

It is preferred that the lowest point of second end 133 of pivot arm 131 does not penetrate cover deck aperture 224. Such penetration is disadvantageous because pivot arm 131 is exposed to view from below; cover deck aperture 224 must be larger to accommodate the journal between the second end 133 of pivot arm 131 and first end 141 of link arm 140; and because there is increased probability that the journal between the second end 133 of pivot arm 131 and first end 141 of link arm 140 could catch on cover deck aperture 224.

Preferably, the angle between the pivot arm 131 and link arm 140 is minimized at the rest (closed) position. This value is preferably less than 15 degrees. This reduces the rest position torque imposed on the system. Thus, the mirror assembly may be maintained in a closed position when not in use.

An angle of 0 degrees would be ideal, but from a practical standpoint, that does not allow for tolerances and wear in the assembly, and an angle of 15 degrees is suitable.

It is preferred that the maximum torque value exerted on motor shaft 112 be less than 30 in-oz. This is predicated on mirror assembly 300 weighing less than or equal to 5 pounds. This allows use of a relatively small motor (and hence less cost).

It is preferred that the mirror have a range of motion of between 0 and 65 degrees, inclusive. This facilitates different ceiling heights and other configurations.

Figure 4:
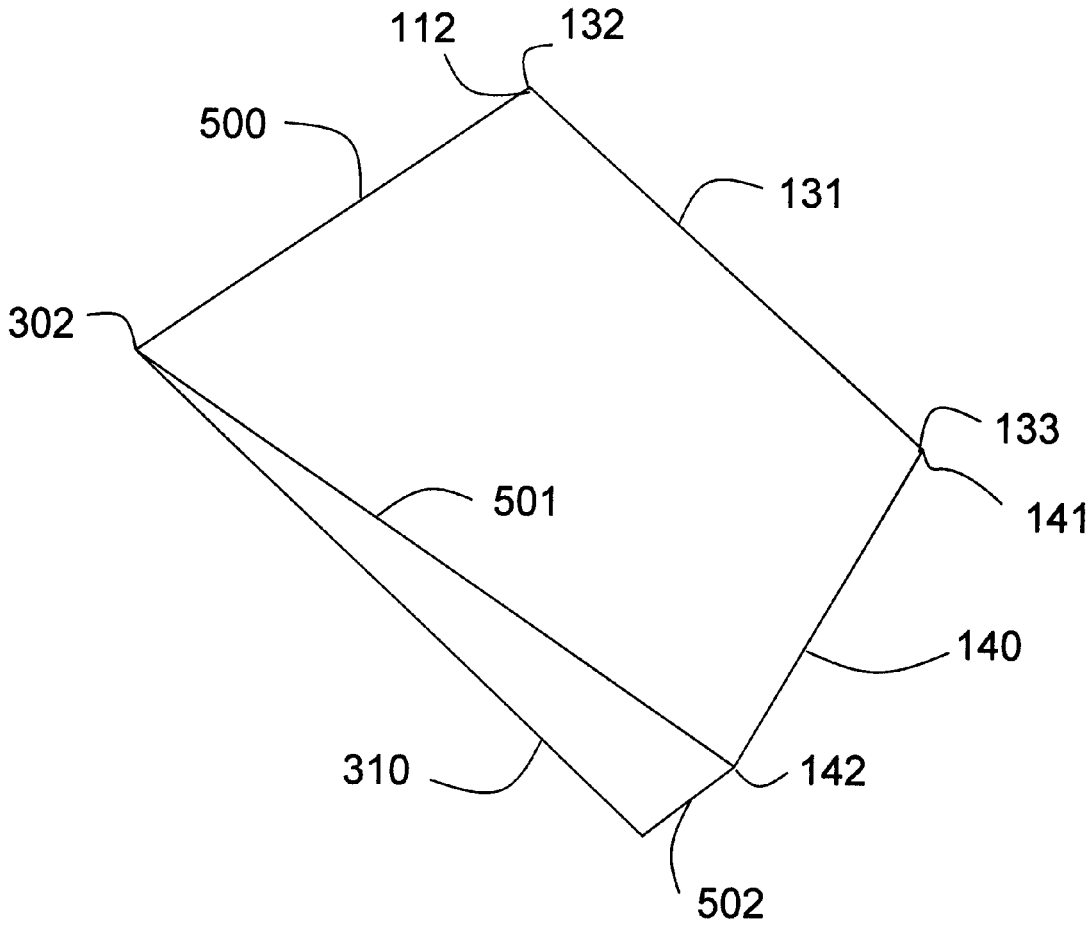
FIG. 4 depicts a graphical representation of the four bar linkage model
Figure 5:
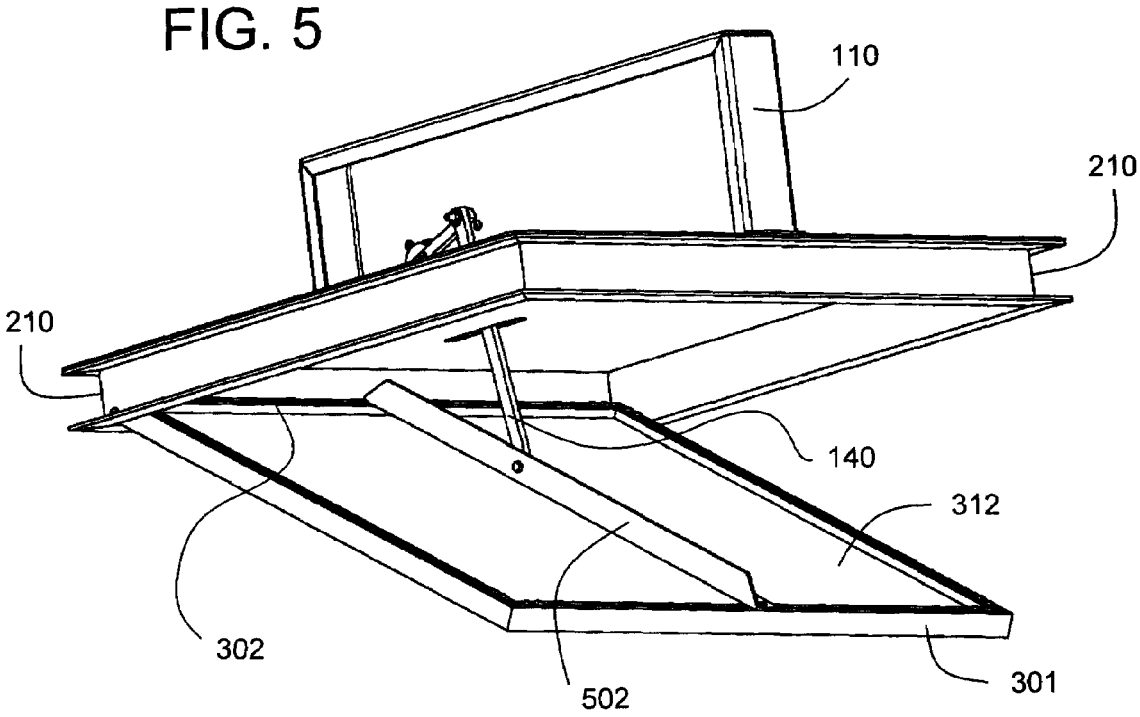
FIG. 5 depicts a perspective view showing the underside of the invention
Figure 6:
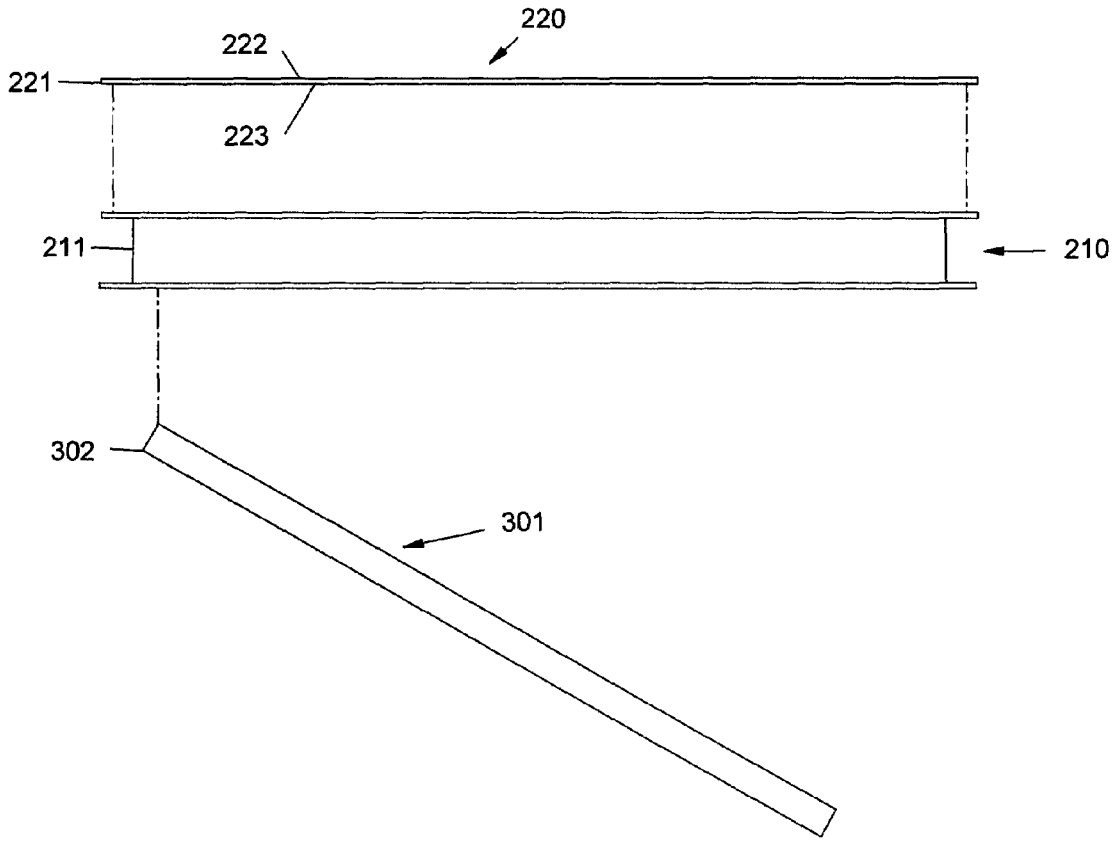
FIG. 6 depicts an exploded side view showing frame 210, cover deck 220, and mirror frame 301.

Referring now to FIG. 4, a four-bar linkage model comprises links A, B, C & D wherein:

Link #A (500) (i.e. "frame link", "ground link, or "fixed link") is motionless and relates to the motor shaft 112 and first side 302 of mirror frame; link #B (131) relates to pivot arm 131; link #C (140) relates to link arm 140; and link #D (501) relates to first side 302 of mirror frame and second end 142 of link arm 140.

Clevis arrangement 502 represents the offset distance from mirror rear surface 312 to second end 142 of link arm 140, the point of pivotal connection.

As will be appreciated to those of skill in the art, multitude embodiments are possible. While the following values yield favorable results (maximize the aforementioned favorable conditions), other configurations may be used. A preferred embodiment of the present invention comprises:

The distance between the center of motor shaft 112 and first side 302 of mirror frame be substantially 5.4 inches; pivot arm 131 be substantially 3 inches long; Link arm 140 be substantially 8.9 inches long; and the distance between first side 302 of mirror frame 301 and second end 142 of link arm 140 be substantially 7.94 inches.

The invention is operated by a remote control device 400 (not shown in drawings). As will be apparent to those of skill in the art, the remote control device 400 is of common type and comprises a transmitter and receiver. The transmitter is preferably hand held and operated by the pregnant mother, physician, or other nearby person. The receiver is preferably mounted on or near the motor that it controls. The motor must operate in forward and reverse modes thus opening and closing the mirror.

The transmitter and receiver may communicate using various forms of energy such as electronic, electromagnetic, sound, light, or mechanical (a long rod, etc.) It is preferred that the communication link between receiver and transmitter be wireless. However, a wired configuration is also effective.

Other methods of remote control may be used. For example, a voice activated system whereby the receiver responds to the user's (or other person) voice.

Means for limiting the movement of the mirror assembly comprises using limit switches. Limit switches are known in the art. Accordingly various types may be used.

The limit switches allow mirror assembly 300 to be stopped flush with a ceiling in the closed position and further restrict movement of mirror assembly 300 in the open position. Allowing the mirror to over-extend in the open position can cause pivot assembly 130 to lock or otherwise malfunction.

As will be appreciated by those of skill in the art, various means may be used to accomplish the function of limiting the movement of the mirror assembly. One preferred embodiment comprises placing the limit switches about the periphery of motor shaft 112 such that pivot arm 131 engages the upper and lower limit switches as it moves between the open and closed positions.

Another preferred embodiment comprises placing the limit switches adjacent mirror assembly 300 such the limit switches are engaged by the mirror assembly as it moves between fully open and fully closed positions.

What is claimed is:

1. A concealable mirror comprising:

a base unit comprising a cover deck and a frame, said cover deck being substantially planar, said cover deck having an aperture, a first side, an upper surface, and a lower surface, said frame being rectangular in shape, said aperture being located approximate the center of said cover deck, said frame having a first side, said frame being fixedly secured to said lower surface of said cover deck, said first side of said cover deck being adjacent to said first side of said frame;

a mirror assembly comprising a mirror and a mirror frame, said mirror frame being rectangular in shape and having a first side, said mirror having a reflective surface and a rear surface and being fixedly secured to said mirror frame, said reflective surface of said mirror facing away from said cover deck;

a remote control device for operating the concealable mirror;

said first side of said frame being hingedly secured to said first side of said mirror frame;

a motor assembly comprising a motor housing, a motor, a motor shaft, and a pivot assembly, said motor housing being fixedly attached to said upper surface of said cover deck, said motor being fixedly attached to said motor housing;

said pivot assembly comprising a pivot arm and a link arm, said pivot arm having first and second ends, said first end of said pivot arm being fixedly secured to said motor shaft, said link arm and having first and second ends, said second end of said pivot arm being pivotably secured to said first end of said link arm, means for pivotally attaching said second end of said link arm to said rear surface of said mirror;

whereby said mirror assembly may be moved between an open and closed position;

further whereby said mirror assembly may be stopped flush with a ceiling in the closed position.

2. The concealable mirror of claim 1 further comprising:

said means for pivotally attaching said second end of said link arm to said rear surface of said mirror comprises said second end of said link arm being pivotably secured to a clevis arrangement, said clevis arrangement being fixedly secured to said rear surface of said mirror.

3. The concealable mirror of claim 1 further comprising:

said frame being comprised of elongated, rigid members having a c-shaped cross section, and being 2 inches high.

4. The concealable mirror of claim 1 further comprising:

said mirror assembly weighing less than or equal to 5 lbs.

5. The concealable mirror of claim 1 further comprising:

said frame and said mirror assembly capable of planar movement with respect to each other from 0 to 65 degrees, inclusive.

6. The concealable mirror of claim 1 further comprising:

said pivot arm being substantially 3 inches in length.

7. The concealable mirror of claim 1 further comprising:

said pivot arm having a range of movement such that said pivot arm does not penetrate said aperture of said cover deck.

8. The concealable mirror of claim 1 further comprising:

said link arm being substantially 8.9 inches in length.

9. The concealable mirror of claim 1 further comprising:

said pivot arm and said link arm having a pivotal rotation with respect to each other from zero to 180 degrees, inclusive.

10. The concealable mirror of claim 1 further comprising:

said motor shaft experiencing a torque of less than or equal to 30 in-oz.

11. The concealable mirror of claim 1 further comprising:

said frame being comprised of elongated, rigid members having a c-shaped cross section, and being 2 inches high;

said mirror assembly weighing less than or equal to 5 lbs;

said frame and said mirror assembly capable of planar movement with respect to each other from 0 to 65 degrees, inclusive;

said pivot arm being substantially 3 inches in length;

said pivot arm having a range of movement such that said pivot arm does not penetrate said aperture of said cover deck;

said link arm being substantially 8.9 inches in length;

said pivot arm and said link arm having a pivotal rotation with respect to each other from zero to 180 degrees, inclusive;

said motor shaft experiencing a torque of less than or equal to 30 in-oz;

said means for pivotally attaching said second end of said link arm to said rear surface of said mirror comprises said second end of said link arm being pivotably secured to a clevis arrangement, said clevis arrangement being fixedly secured to said rear surface of said mirror.

12. A concealable mirror comprising:

a base unit comprising a cover deck and a frame, said cover deck being substantially planar, said cover deck having an aperture, a first side, an upper surface, and a lower surface, said frame being rectangular in shape and further being comprised of elongated, rigid members having a c-shaped cross section, and being 2 inches high, said aperture being located approximate the center of said cover deck, said frame having a first side, said frame being fixedly secured to said lower surface of said cover deck, said first side of said cover deck being adjacent to said first side of said frame;

a mirror assembly comprising a mirror and a mirror frame, said mirror assembly weighing less than or equal to 5 lbs, said mirror frame being rectangular in shape and having a first side, said mirror having a reflective surface and a rear surface and being fixedly secured to said mirror frame, said reflective surface of said mirror facing away from said cover deck;

said first side of said frame being hingedly secured to said first side of said mirror frame;

said frame and said mirror assembly capable of planar movement with respect to each other from 0 to 65 degrees, inclusive;

a motor assembly comprising a motor housing, a motor, a motor shaft, and a pivot assembly, said motor housing being fixedly attached to said upper surface of said cover deck, said motor being fixedly attached to said motor housing;

a remote control device for operating the concealable mirror;

said pivot assembly comprising a pivot arm, a link arm, and a clevis arrangement, said pivot arm having first and second ends, said first end of said pivot arm being fixedly secured to said motor shaft, said link arm and having first and second ends, said second end of said pivot arm being pivotably secured to said first end of said link arm, said second end of said link arm being pivotably secured to said clevis arrangement, said clevis arrangement being fixedly secured to said rear surface of said mirror;

said pivot arm and said link arm having a pivotal rotation with respect to each other from zero to 180 degrees, inclusive;

said motor shaft experiencing a torque of less than or equal to 30 in-oz;

whereby said mirror assembly may be moved between an open and closed position;

further whereby said mirror assembly may be stopped flush with a ceiling in the closed position.

* * * * *